United States Patent [19]

Bailey et al.

[11] Patent Number: 4,887,369

[45] Date of Patent: Dec. 19, 1989

[54] CHANGEABLE SHOE TOPS/HEELS

[76] Inventors: Angileen Bailey, 6701 Stearns, Houston, Tex. 77021; George Spector, 233 Broadway, Rm. 3815, New York, N.Y. 10007

[21] Appl. No.: 231,686

[22] Filed: Aug. 12, 1988

[51] Int. Cl.[4] ..... A43B 3/24

[52] U.S. Cl. ..... 36/101; 36/15

[58] Field of Search ..... 36/101, 100, 15, 34 B

[56] References Cited

U.S. PATENT DOCUMENTS

| | | | |
|---|---|---|---|
| 2,183,277 | 12/1939 | Heilhecker | 36/101 X |
| 2,368,314 | 1/1945 | Marx | 36/101 X |
| 2,767,488 | 10/1956 | Meltzer | 36/34 B |
| 4,115,933 | 9/1978 | Chiaramonte, Jr. | 36/100 X |
| 4,377,042 | 3/1983 | Bauer | 36/101 |

FOREIGN PATENT DOCUMENTS

| | | | |
|---|---|---|---|
| 2263269 | 3/1974 | Fed. Rep. of Germany | 36/101 |
| 2523299 | 12/1976 | Fed. Rep. of Germany | 36/101 |
| 582963 | 10/1958 | Italy | 36/15 |

*Primary Examiner*—James Kee Chi

[57] ABSTRACT

A convertible shoe is provided and consists of a shoe bottom that has a formed outside portion, a middle shank and a raised heel; a shoe top that has a midsole, an insole and an upper vamp portion and fasteners for removably attaching the shoe top to the shoe bottom.

3 Claims, 1 Drawing Sheet

CHANGEABLE SHOE TOPS/HEELS

BACKGROUND OF THE INVENTION

The instant invention relates generally to footwear and more specifically it relates to a convertible shoe.

Numerous types of footwear have been provided in prior art that are adapted to include replaceable or substitutable components. For example, U.S. Pat. Nos. 2,552,943; 3,925,915 and 4,363,177 all are illustrative of such prior art. While these units may be suitable for the particular purpose to which they address, they would not be as suitable for the purposes of the present invention as heretofore described.

SUMMARY OF THE INVENTION

A primary object of the present invention is to provide a convertible shoe that will overcome the shortcomings of the prior art devices.

Another object is to provide a convertible shoe that includes a shoe top having a midsole, and insole and an upper vamp portion that can be removably attached to a shoe bottom having a forward outside portion, a middle shank and a raised heel.

An additional object is to provide a convertible shoe in which the upper vamp portion is removably attached to the midsole wherein various vamp portions can be utilized having different colors and designs.

A further object is to provide a convertible shoe that is simple and easy to use.

A still further object is to provide a convertible shoe that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
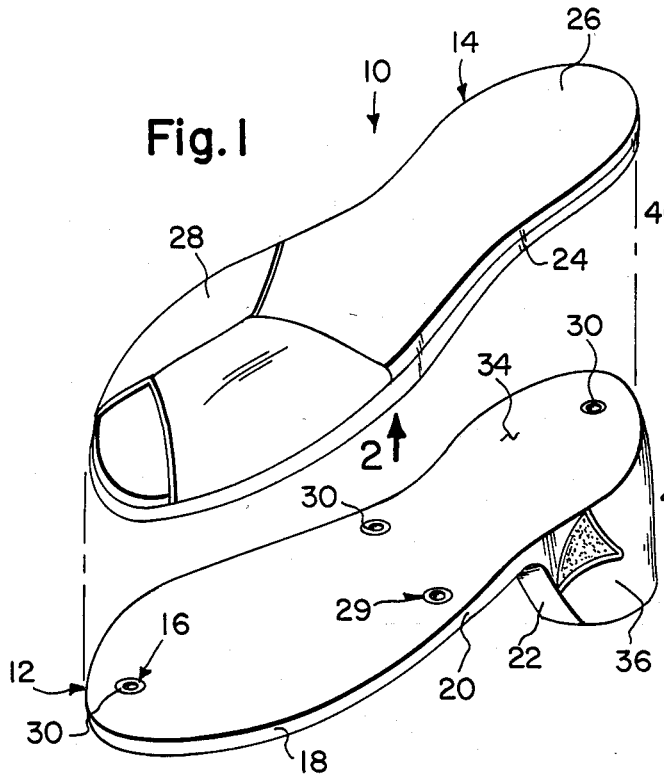
FIG. 1 is a partial exploded perspective view of the invention.
Figure 2:
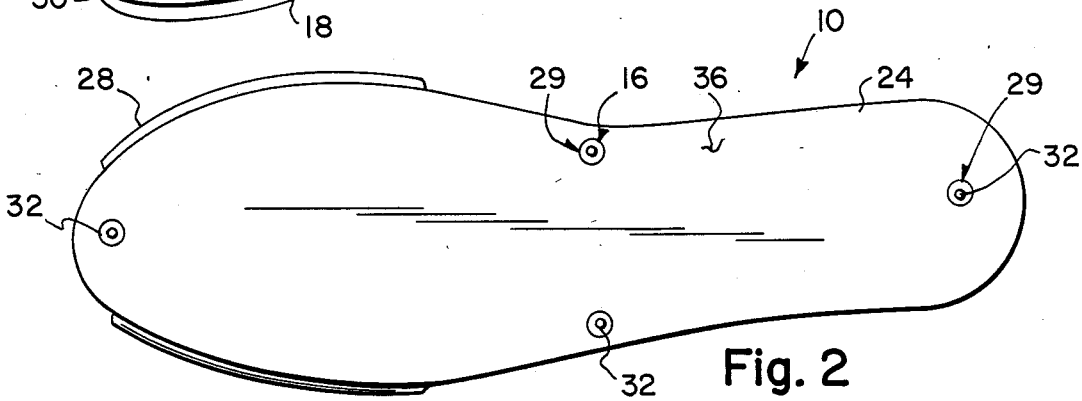
FIG. 2 is a bottom view of the midsole as indicated by arrow 2 in FIG. 1.

Turning now descriptively to the drawings, in which similar reference characters denote similar elements throughout the several views, FIGS. 1 and 2 illustrate a convertible shoe 10 consisting of a shoe bottom 12, a shoe top 14 and connectors for removably attaching the shoe top 14 to the shoe bottom 12. The shoe bottom 12 has a forward outsole portion 18, a middle shank 20 and a raised heel 22, while the shoe top 14 has a midsole 24, an insole 26 and an upper vamp portion 28.

The connectors 16 are a plurality of snap fasteners 29 having female socket segments 30 and male stud segments 32. The female socket segments 30 are spaced apart and contained within top surface 34 of the forward outsole portion 18, the middle shank 20 and the raised heel 22. The male stud segments 32 are spaced apart and contained within bottom surface 36 of the midsole 24 so that the male stud segments 32 will communicate with the female socket segments 30. Peel away heel tape 36 is also provided so that various tapes can be utilized having different colors and designs to match up with the upper vamp portion 28.

Figure 3:
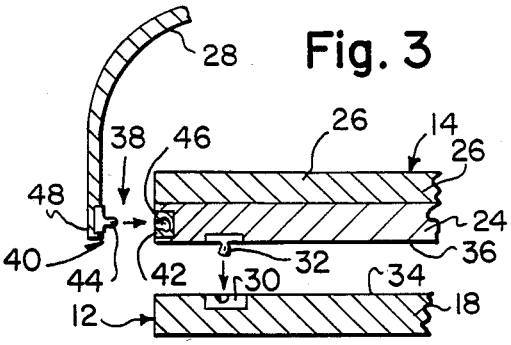
FIG. 3 is a fragmentary exploded cross sectional view of a modification showing the upper vamp portion removably connected to the midsole which is then removably connected to the shoe bottom.

On of a second set of connectors 38 is shown in FIG. 3 for removably attaching the upper vamp portion 28 to the midsole 24. The connectors 38 include a plurality of snap fasteners 40 having female socket segments 42 and male stud segments 44. The female socket segments 42 are spaced apart and contained within each side 46 of the midsole 24 while the male stud segments 44 are spaced apart and contained within each bottom end 48 of the upper vamp portion 28 so that the male stud segments 44 will communicate with the female socket segments 42.

Figure 4:
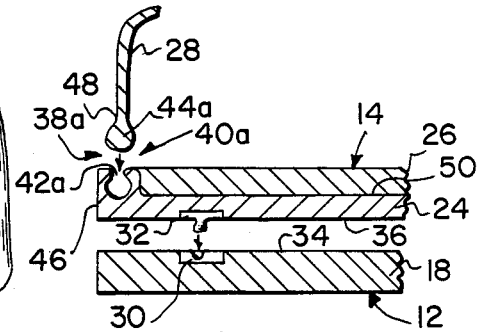
FIG. 4 is a fragmentary exploded cross sectional view of a second modification showing the upper vamp portion removably connected to the midsole.

FIG. 4 shows one of a modified second set of connectors **38*a* which include a plurality of snap fasteners 40*a* having female socket segments 42*a* and male stud segments 44a. The female socket segments 42*a* are spaced apart and formed on top surface 50 at each side 46 of the midsole 24 while the male stud segments 44a are spaced apart and formed on each bottom end 48 of the upper vamp portion 28 so that the male stud segments 44a will communicated with the female socket segments 42*a***.

Figure 5:
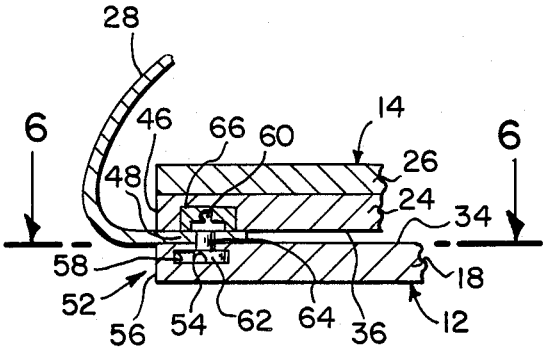
FIG. 5 is a fragmentary cross sectional view of a third modification showing the upper vamp portion removably connected to both the midsole and outsole by a two headed fastener member.
Figure 6:
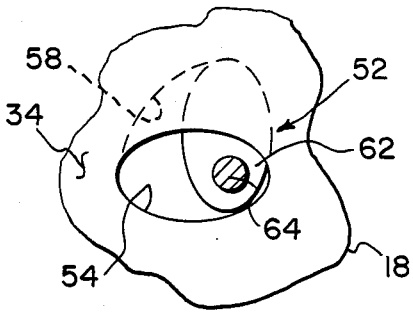
FIG. 6 is an enlarged cross sectional view taken along line 6—6 in FIG. 5 showing the hole and undercut in greater detail.

FIGS. 5 and 6 show one of another set of connectors 52 for removably attaching the upper vamp portion 28 between the midsole 24 and the forward outsole portion 18 and includes the forward outsole portion 18 having a plurality of apertures 54 spaced apart and formed within top surface 34 along each side 56 thereof, whereby each of the apertures 54 has an undercut 58 therein. A plurality of male stud segments 60 are spaced apart and contained within each bottom end 48 of the upper vamp portion 28. A plurality of head 62 are provided in which each is pivotly attached at 64 to other side of one of the male stud segments 60 so as to communicate within one of the apertures 54 and swivel into the undercut 58, as best seen in FIG. 6. A plurality of female socket segments 66 are spaced apart and contained within bottom surface 36 near neach side 46 of the midsole 24 to communicate with the male stud segments 60.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A convertible shoe which comprises:

(a) a shoe bottom having a forward outsole portion, a middle shank, a raised heel, and an upper surface;

(b) a shoe top having a midsole with top, bottom, and side surfaces, an insole, and an upper vamp portion with bottom ends;

(c) means for removably attaching said shoe top to said shoe bottom wherein said means includes a plurality of snap fasteners having female socket segments and male stud segments, said female socket segments are spaced apart on said upper surface while said male stud segments are spaced apart on said bottom surface of said midsole, so that said male stud segments will communicate with said female socket segments, further comprising means for removably attaching said upper vamp portion to said midsole wherein the second said means includes a plurality of snap fasteners having female socket segments and male stud segments, said female socket segments are spaced apart on said midsole while said male stud segments are spaced apart on said bottom ends of said upper vamp portion so that said male stud segments will communicate with said female socket segments.

2. A convertible shoe as recited in claim 1, wherein said second means includes a plurality of snap fasteners having female socket segments and male stud segments, said female sockets are spaced apart and formed on each said side of said midsole while said male stud segments are spaced apart and formed on an inner surface of each bottom end of said upper vamp portion so that said male stud segments will provide a connection with said female socket segments, thereby screening the connection from external view.

3. A convertible shoe comprising a bottom, a top with a midsole, and a vamp including means for removeable attaching said bottom and top with a portion of the vamp therebetween, said means comprising:

(a) said bottom having an upper surface with a plurality of apertures having an undercut therein;

(b) said vamp hav ing a plurality of male stud segments spaced apart extending from said vamp;

(c) a plurality of heads, each of which is pivotly attached to one end of each said male stud segments so as to communicate within one of said apertures and swivel into said undercut; and (d) a plurality of female socket segments spaced apart on a bottom surface of said midsole to connect with an opposite end of each said male stud segments, whereby said vamp is removably connected between said bottom and top by means of a convenient pivotal connection.

* * * * *